US007450080B2

(12) United States Patent
Stephens

(10) Patent No.: US 7,450,080 B2
(45) Date of Patent: Nov. 11, 2008

(54) DECOHERENCE PLATE FOR USE IN A COMMUNICATIONS SYSTEM

(75) Inventor: Scott Adam Stephens, Phoenix, AZ (US)

(73) Assignee: Navcom Technology, Inc., Torrance, CA (US)

( * ) Notice: Subject to any disclaimer, the term of this patent is extended or adjusted under 35 U.S.C. 154(b) by 486 days.

(21) Appl. No.: 11/104,007

(22) Filed: Apr. 11, 2005

(65) Prior Publication Data

US 2005/0237259 A1 Oct. 27, 2005

Related U.S. Application Data

(63) Continuation-in-part of application No. 10/614,097, filed on Jul. 3, 2003, now Pat. No. 7,250,901.

(51) Int. Cl.
*H01Q 9/16* (2006.01)
*H01Q 1/52* (2006.01)

(52) U.S. Cl. ..... 343/793; 343/841

(58) Field of Classification Search ..... 343/793, 343/817, 818, 841
See application file for complete search history.

(56) References Cited

U.S. PATENT DOCUMENTS

| | | | | |
|---|---|---|---|---|
| 4,104,634 A | | 8/1978 | Gillard et al. | 343/18 C |
| 4,359,743 A | * | 11/1982 | DeSantis | 343/792 |
| 4,710,020 A | | 12/1987 | Maddox et al. | 356/1 |
| 4,829,442 A | | 5/1989 | Kadonoff et al. | 364/449 |
| 4,873,449 A | | 10/1989 | Paramythioti et al. | 250/560 |
| 5,375,059 A | | 12/1994 | Kyrtsos et al. | 364/449 |
| 5,390,125 A | | 2/1995 | Sennott et al. | 364/449 |
| 5,438,517 A | | 8/1995 | Sennott et al. | 364/449 |
| 5,483,241 A | | 1/1996 | Waineo et al. | 342/29 |
| 5,572,427 A | | 11/1996 | Link et al. | 364/443 |

(Continued)

FOREIGN PATENT DOCUMENTS

DE 19910715 A1 9/2000

(Continued)

OTHER PUBLICATIONS

International Search Report for International Application No. PCT/US2006/009499, mailed Jul. 19, 2006.

(Continued)

*Primary Examiner*—Shih-Chao Chen
(74) *Attorney, Agent, or Firm*—Morgan, Lewis & Bockius LLP

(57) ABSTRACT

A decoherence plate provides reduced field coupling or improved isolation between two or more antennas. An antenna module includes a first antenna, a second antenna and a decoherence plate having a surface. The first antenna transmits one or more electromagnetic signals. The surface of the decoherence plate is positioned in a plane perpendicular to a line connecting the first antenna and the second antenna. For each first path from the first antenna to the plane to the second antenna, in a plurality of paths having a range of path lengths, there is a corresponding second path, from the first antenna to the plane to the second antenna, that is substantially 180° out of phase for a respective wavelength in the one or more electromagnetic signals transmitted by the first antenna. In this way, the decoherence plate reduces the field coupling between the first antenna and the second antenna.

32 Claims, 7 Drawing Sheets

U.S. PATENT DOCUMENTS

| | | | | |
|---|---|---|---|---|
| 5,610,815 | A | 3/1997 | Gudat et al. | 364/424.02 |
| 5,640,323 | A | 6/1997 | Kleimenhagen et al. | 364/423.98 |
| 5,657,226 | A | 8/1997 | Shin et al. | 364/424.02 |
| 5,657,317 | A | 8/1997 | Mahany et al. | 370/338 |
| 5,874,918 | A | 2/1999 | Czarnecki et al. | 242/417 |
| 5,933,079 | A | 8/1999 | Frink | 340/539 |
| 5,952,983 | A * | 9/1999 | Dearnley et al. | 343/817 |
| 5,982,164 | A | 11/1999 | Czarnecki et al. | 324/76.33 |
| 5,986,602 | A | 11/1999 | Frink | 342/126 |
| 6,011,974 | A | 1/2000 | Cedervall et al. | 455/456 |
| 6,072,421 | A | 6/2000 | Fukae et al. | 342/42 |
| 6,424,264 | B1 | 7/2002 | Giraldin et al. | 340/573.1 |
| 6,427,079 | B1 | 7/2002 | Schneider et al. | 600/424 |
| 6,459,966 | B2 | 10/2002 | Nakano et al. | 701/23 |
| 6,489,917 | B2 | 12/2002 | Geisheimer et al. | 342/127 |
| 6,525,688 | B2 | 2/2003 | Chou et al. | 342/357.06 |
| 6,542,131 | B1 * | 4/2003 | Haapanen | 343/813 |
| 6,556,942 | B1 | 4/2003 | Smith | 702/150 |
| 6,608,593 | B2 | 8/2003 | Holt | 342/453 |
| 6,720,935 | B2 | 4/2004 | Lamensdorf et al. | 343/895 |
| 2001/0051527 | A1 | 12/2001 | Kuwahara et al. | 455/456 |
| 2003/0005030 | A1 | 1/2003 | Sutton et al. | 709/200 |
| 2003/0007473 | A1 | 1/2003 | Strong et al. | 370/338 |

FOREIGN PATENT DOCUMENTS

| | | | |
|---|---|---|---|
| EP | 0117240 | | 8/1984 |
| EP | 0325539 | A1 | 7/1989 |
| EP | 0961134 | A1 | 12/1999 |
| FR | 1039651 | | 10/1953 |
| FR | 2478380 | | 9/1981 |
| GB | 1047577 | | 11/1966 |
| JP | 56013812 | | 2/1981 |
| WO | PCT/US2004/213666 | | 12/2004 |

OTHER PUBLICATIONS

Edelsbrunner, H., et al., "Quadratic Time Algorithm for the Minmax Length Triangulation," *Proceedings of the 32nd Annual Symposium on Foundations of Computer Science*, San Juan, Puerto Rico, 1999, pp. 414-423.

Afsar, M.N., "A New Wideband Cavity-Backed Spiral Antenna," *Proceedings of the 2001 IEEE Antennas and Propagation Society Int'l Symposium*, vol. 4, 2001, pp. 124-127.

Michelson, D.G., et al., "Use of Circular Polarization in a Marine Radar Positioning System," *Remote Sensing: An Economic Tool for the Nineties*, IGARAA '99, Jul. 10-14, 1999.

Hecht, E., et al., *Optics*, Addison-Wesley Publishing, Chapter 10, 1974, pp. 329-396.

Jackson, J.D., *Classical Electrodynamics*, 2nd Ed., John Wiley & Sons, Chapter 9, 1975, pp. 391-468.

* cited by examiner

DECOHERENCE PLATE FOR USE IN A COMMUNICATIONS SYSTEM

This application is a continuation-in-part of U.S. patent application Ser. No. 10/614,097, filed Jul. 3, 2003, now U.S. Pat. No. 7,250,901. U.S. patent application Ser. No. 10/614,097 is incorporated herein by reference in its entirety.

FIELD OF THE INVENTION

The present invention relates generally to electromagnetic antennas, and more specifically, to antennas and related communications systems that include a decoherence plate.

BACKGROUND OF THE INVENTION

Antennas radiate and receive intentional and unintentional electromagnetic signals. The unintentional signals, also known as field coupling or electromagnetic interference, may result from current-carrying traces, wires and other conductors, as well as from other antennas in a same or a different antenna module or structure. Unintentional signals associated with current-carrying traces, wires and other conductors can be minimized through proper circuit design and board layout, including the use of multilayer printed circuit boards with separate ground planes and/or the use of electromagnetic interference (EMI) shielding.

As illustrated in FIG. 1, conventional EMI shielding 100 uses a highly conductive metal plate, sheet or layer 110, inserted between one or more antennas and one or more circuits, to attenuate incident electric fields 112 by reflecting electric fields 114 and absorbing a portion of the electric fields. A portion of the electric fields is transmitted 116_1. There may also be internal reflections of the electric fields 118 that give rise to additional transmitted electric fields 116_2. An amount of attenuation of the electric fields will depend on factors such as a frequency and wavelength of the electromagnetic signals, the conductivity and permeability of the metal, its distance from the antenna and, if the wavelength of the electromagnetic signals is on the order of the thickness of the metal plate, sheet or layer 110, a thickness of the metal plate, sheet or layer 110. EMI shielding may be a simple metal sheet or foil layer, or an enclosure, such as a Faraday cage.

Unintentional electromagnetic signals associated with other antennas are common since multiple antennas are often implemented in close proximity. A high isolation of a respective antenna is often necessary to achieve good performance (a high signal-to-noise ratio, a low bit error rate, etc.) in a communication system. There are a variety of conventional techniques for improving the isolation between two or more antennas. One such approach isolates a transmit and a receive path in the communications system, for example, by using a transmit-receive isolation switch or a transmit-receive grating in conjunction with a delay line. Another approach divides a frequency spectrum into a set of orthogonal sub-bands by using coding techniques such as orthogonal frequency division multiplexing and bit loading.

In addition to these approaches, there are a variety of conventional techniques for isolating two or more antennas from one another by decoupling beam patterns of the antennas. Such techniques include modifying a directivity of the beam patterns (by antenna design and/or antenna placement), increasing a free space path loss (by physically separating the antennas), EMI shielding, one or more ground planes and, if possible, polarization isolation. While these techniques can improve antenna isolation, there are limits to the overall efficacy. In addition, there are inevitable antenna and communications system design tradeoffs. For example, to be effective, ground planes tend to have a large spatial extent. Such large ground planes add expense, are unwieldy (especially in compact and/or portable communications systems) and may restrict degrees of freedom in antenna design.

There is a need, therefore, for low cost and compact structures to increase the isolation of antennas in communications systems.

SUMMARY

The decoherence plate apparatus and method provide reduced field coupling or improved isolation between two or more antennas. In an embodiment of the apparatus, an antenna module includes a first antenna, a second antenna and a decoherence plate having a surface. The first antenna transmits one or more electromagnetic signals. The surface of the decoherence plate is substantially positioned in a plane that is substantially perpendicular to a line connecting the first antenna and the second antenna. For each first path from the first antenna to the plane to the second antenna there is a corresponding second path, from the first antenna to the plane to the second antenna, that is substantially 180° out of phase for a respective wavelength in the one or more electromagnetic signals transmitted by the first antenna. Both the first and second paths are selected from the set of paths falling within a predefined range of path lengths. In this way, the decoherence plate reduces the field coupling between the first antenna and the second antenna.

In some embodiments, the surface of the decoherence plate is intercepted by the line connecting the first antenna and the second antenna.

In some embodiments, the field coupling between the first antenna and the second antenna at the respective wavelength is at least 30 dB less than a field coupling corresponding to free space path loss between the first antenna and the second antenna. In some embodiments, the field coupling between the first antenna and the second antenna at the respective wavelength is between 40 and 70 dB less than the field coupling corresponding to free space path loss between the first antenna and the second antenna.

In some embodiments, the decoherence plate includes a metal layer. The metal layer may be thicker than a skin depth of the metal, the skin depth corresponding to a minimum frequency of the one or more electromagnetic signals transmitted by the first antenna. The metal layer may be copper, aluminum, gold, silver and their related alloys and oxides.

In some embodiments, the metal layer is patterned into a predetermined shape. The predetermined shape may have a maximum lateral extent that is no larger than a distance separating a dipole moment of the first antenna from a dipole moment of the second antenna. In other embodiments, the maximum lateral extent may be no larger than half the distance separating the dipole moment of the first antenna from the dipole moment of the second antenna. The decoherence plate may include a substrate, where the metal layer is deposited in a layer located above a surface of the substrate. In some embodiments, the substrate is a circuit board.

In an embodiment of the method, a shape of the decoherence plate for a respective geometry having a first antenna and a second antenna is determined by selecting a shape of the decoherence plate in a plane substantially perpendicular to a line connecting the first antenna and the second antenna. A field coupling between the first antenna and the second antenna for a respective wavelength of an electromagnetic signal is determined. A next shape of the decoherence plate is selected in accordance with a result from the determined field coupling. The determining of the field coupling and the selection of the next shape are repeated until the field coupling between the first antenna and the second antenna is less than a threshold.

In some embodiments, the field coupling is determined by summing a Kirchoff diffraction kernel in the plane of the decoherence plate at least over a surface area including the shape of the decoherence plate. The Kirchoff diffraction kernel may include a product of a weighting component, a spherical wave Green's function and an obliquity component that includes a near-field expression. In other embodiments, the summing is performed in the plane of the decoherence plate over a surface area extending beyond that defined by the shape of the decoherence plate.

In some embodiments, the field coupling is determined for two or more wavelengths in the electromagnetic signal. The weighting component may include a real portion and an imaginary portion. The decoherence plate may include two or more separate segments.

Additional variations on the apparatus and method embodiments are provided.

BRIEF DESCRIPTION OF THE DRAWINGS

Additional objects and features of the invention will be more readily apparent from the following detailed description and appended claims when taken in conjunction with the drawings.

Like reference numerals refer to corresponding parts throughout the several views of the drawings.

DESCRIPTION OF EMBODIMENTS

Reference will now be made in detail to embodiments of the invention, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the present invention.

Figure 2:
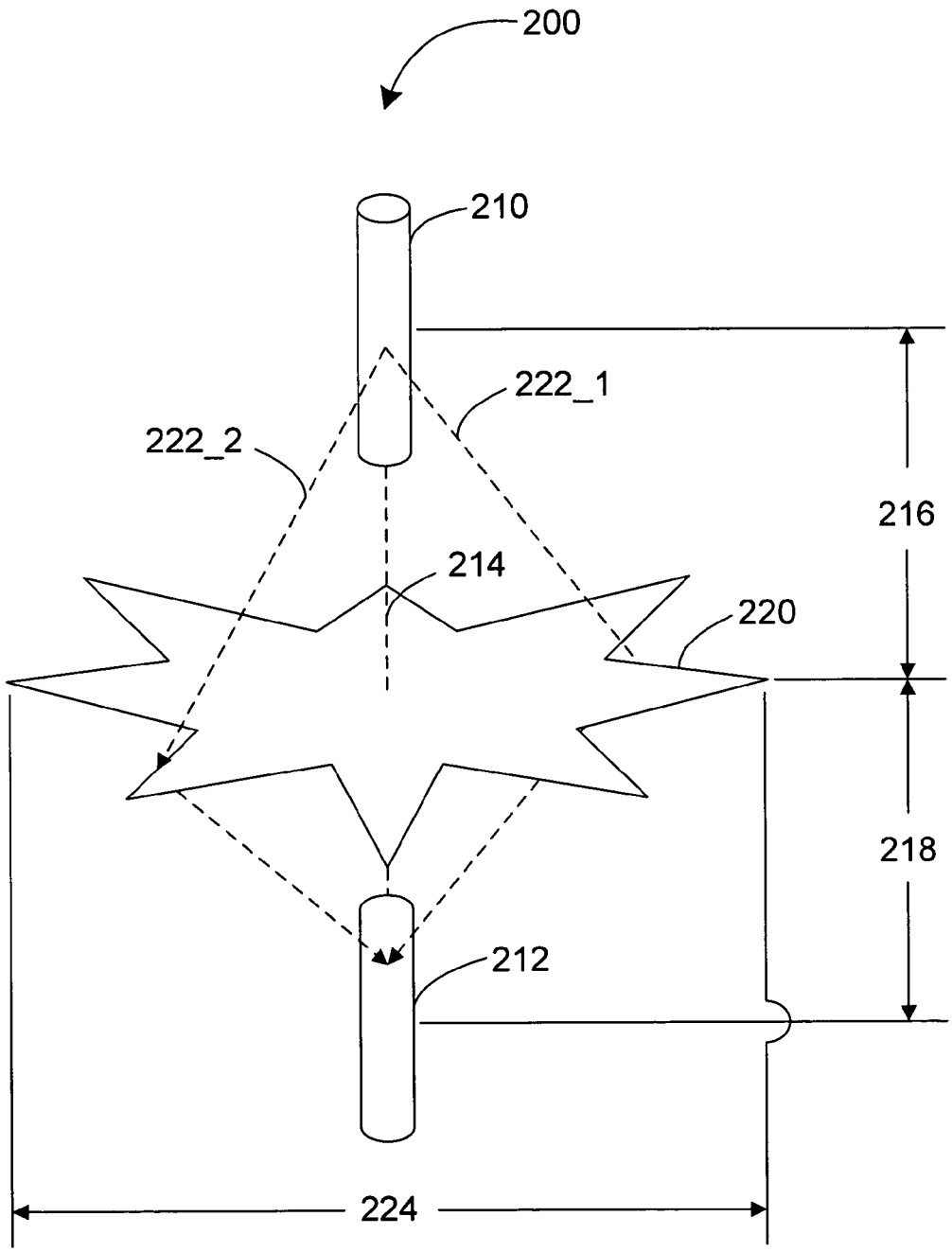
FIG. 2 is a diagram illustrating an antenna module and a decoherence plate.

FIG. 2 illustrates an antenna module 200 including a first antenna 210, a second antenna 212 and a decoherence plate 220 having a surface. In other embodiments, the antenna module 200 may include three or more antennas and/or two or more decoherence plates. The first antenna 210 transmits one or more electromagnetic signals. The surface of the decoherence plate 220 is substantially positioned in a plane 318 (FIG. 3) that is substantially perpendicular to a line 214 connecting the first antenna 210 and the second antenna 212. The surface of the decoherence plate 220 is a first distance 216 from an electric dipole moment, henceforth referred to as the dipole moment, corresponding to the first antenna 210 and a second distance 218 from a dipole moment corresponding to the second antenna 212.

The dipole moment of a pair of opposite charges of magnitude q is defined as the magnitude of the charge times the distance between the charges. A positive direction for the dipole moment is defined towards a positive charge. For an antenna, such as the first antenna 210, which has spatial dimension larger than a respective wavelength in the one or more electromagnetic signals, the dipole moment may represent a significant or dominant term in a multi-pole expansion of the antenna or field pattern. In some embodiments, where the antenna, such as the first antenna 210, does not have a dipole moment, the first distance 216 and the second distance 218 may correspond to a dominant term in the multipole expansion for the antenna.

For each first path 222_1 from the first antenna 210 to the plane 318 (FIG. 3) to the second antenna 212 in a plurality of paths having a predefined range of path lengths there is a corresponding second path 222_2, from the first antenna 210 to the plane 318 (FIG. 3) to the second antenna 212, that is substantially 180° out of phase for the respective wavelength in the one or more electromagnetic signals transmitted by the first antenna 210. The first and second paths are both selected from the set of paths having the predefined range of path lengths. In this way, the decoherence plate 220 reduces the field coupling between the first antenna 210 and the second antenna 212 below a threshold. A reduced field coupling is also referred to as a reduced antenna coupling or an increased antenna isolation between the first antenna 210 and the second antenna 212. Field coupling in dB may be defined as 20 times a base-ten logarithm of a percentage field coupling. Depending on an antenna design, the field coupling may be different in a vertical and a horizontal direction.

In the embodiment illustrated in FIG. 2, the surface of the decoherence plate 220 is intercepted by the line 214 connecting the first antenna 210 and the second antenna 212. In other embodiments, the surface of the decoherence plate 220 may not be intercepted by the line 214 connecting the first antenna 210 and the second antenna 212. For example, the decoherence plate 220 may have a hole in its center, or the decoherence plate 220 may not fully surround the point at which the line 214 intersects the plane 318 (FIG. 3).

The threshold is a result of mutual substantial cancellation for the first path 222_1 and the second path 222_2 having a path length difference approximately equal to half the respective wavelength. This results in a deep minimum in the field coupling. A shape of the decoherence plate may be chosen such that mutual cancellation occurs for a plurality of paths from the first antenna 210 to the plane 318 (FIG. 3) to the second antenna 212 and/or for two or more respective wavelengths.

In some embodiments, the threshold for the reduced field coupling between the first antenna 210 and the second antenna 212 at the respective wavelength is at least 30 dB less than a field coupling corresponding to free space path loss between the first antenna 210 and the second antenna 212. In other embodiments, the threshold for the reduced field coupling between the first antenna 210 and the second antenna 212 at the respective wavelength is at least 40 dB less, at least 50 dB less, or at least 60 dB less than the field coupling corresponding to free space path loss between the first antenna 210 and the second antenna 212. In some embodiments, the threshold for the reduced field coupling between the first antenna 210 and the second antenna 212 at the respective wavelength is between 40 and 70 dB less than the field coupling corresponding to free space path loss between the first antenna 210 and the second antenna 212.

Figure 3:
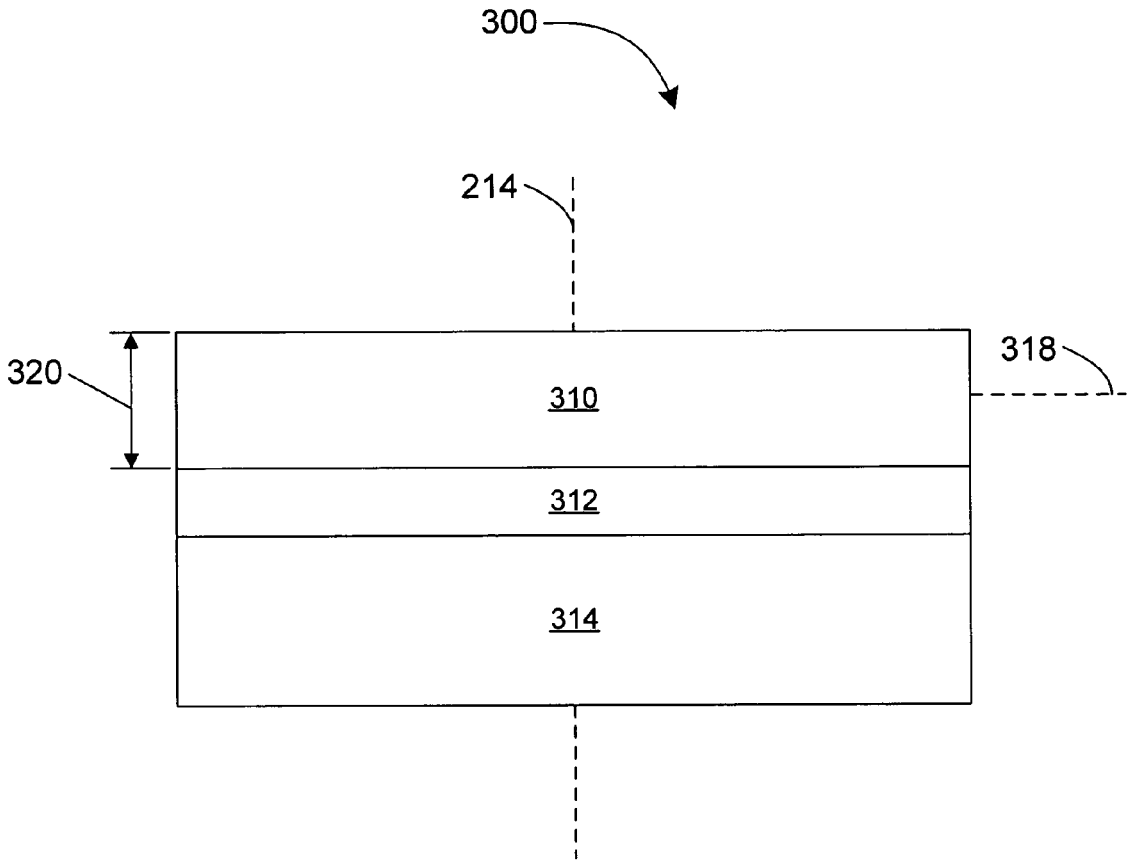
FIG. 3 is a diagram illustrating an embodiment of a decoherence plate.

FIG. 3 illustrates a cross-sectional view of an embodiment 300 of the decoherence plate. The decoherence plate 300 has a first layer 310 substantially in the plane 318. In the embodiment illustrated in FIG. 3, the surface of the decoherence plate 300 is intercepted by the line 214 connecting the first antenna 210 (FIG. 2) and the second antenna 212 (FIG. 2).

In some embodiments, the first layer 310 is a metal. A thickness 320 of the first layer 310 may be thicker than a skin depth of the metal. The skin depth of the metal layer 310 may correspond to a minimum frequency (and thus a maximum wavelength) of the one or more electromagnetic signals transmitted by the first antenna 210 (FIG. 2). In some embodiments, the metal in the first layer 310 may be copper, aluminum, gold, silver, or any of their related alloys, including the related oxides. As is known in the art, however, depending on one or more wavelengths and frequencies in the one or more electromagnetic signals, other materials having sufficient conductivity to attenuate the one or more electromagnetic signals may be used. In other embodiments, materials having a complex dielectric constant, including a real and imaginary portion, may be used in the first layer 310 in order to produce a phase shift in the one or more electromagnetic signals passing through the first layer 310, as is known in the art.

The decoherence plate 300 may include an optional substrate 314. In these embodiments, the first layer 310 is deposited above a surface of the substrate 314. The substrate 314 material and thickness may be chosen to provide sufficient mechanical support and/or integrity to the first layer 310. The substrate 314 may be an insulator or a dielectric. In some embodiments, the substrate 314 is a circuit board.

The decoherence plate may also include one or more optional underlayers 312 between the first layer 310 and the substrate 314. The materials and thicknesses of the one or more underlayers 312 may be chosen to control the properties of the first layer, including mechanical stress, grain size, morphology and orientation, as is known in the art. The one or more underlayers 312 may also be chosen to act as a seed layer to promote growth of the first layer 310. The first layer 310 may be deposited on the substrate 314 and/or the one or more underlayers 312 using techniques such as evaporation, sputtering, electroplating and vapor deposition, as are known in the art.

Referring to FIG. 2, in some embodiments the first layer 310 (FIG. 3) is patterned into a predetermined shape. The predetermined shape may have a maximum lateral extent 224 in the plane 318 (FIG. 3) that is no larger than a distance equal to the sum of the first distance 216 and the second distance 218. In other embodiments, the predetermined shape may have a maximum lateral extent 224 in the plane 318 (FIG. 3) that is no larger than half the distance equal to the sum of the first distance 216 and the second distance 218. In other embodiments, the predetermined shape may have a maximum lateral extent 224 in the plane 318 (FIG. 3) that is no larger than twice the distance equal to the sum of the first distance 216 and the second distance 218. In other embodiments, the predetermined shape may have a maximum lateral extent 224 in the plane 318 (FIG. 3) that is no larger than five times the distance equal to the sum of the first distance 216 and the second distance 218. In still other embodiments, the predetermined shape may have a maximum lateral extent 224 in the plane 318 (FIG. 3) that is no larger than ten times the distance equal to the sum of the first distance 216 and the second distance 218.

In the embodiments described, the decoherence plate 220 reduces the field coupling between the first antenna 210 and the second antenna 212 when the first antenna 210 is transmitting one or more electromagnetic signals. By the principle of reciprocity, the decoherence plate 220 also reduces the field coupling between the first antenna 210 and the second antenna 212 when the second antenna 212 is transmitting one or more electromagnetic signals.

Figure 4:
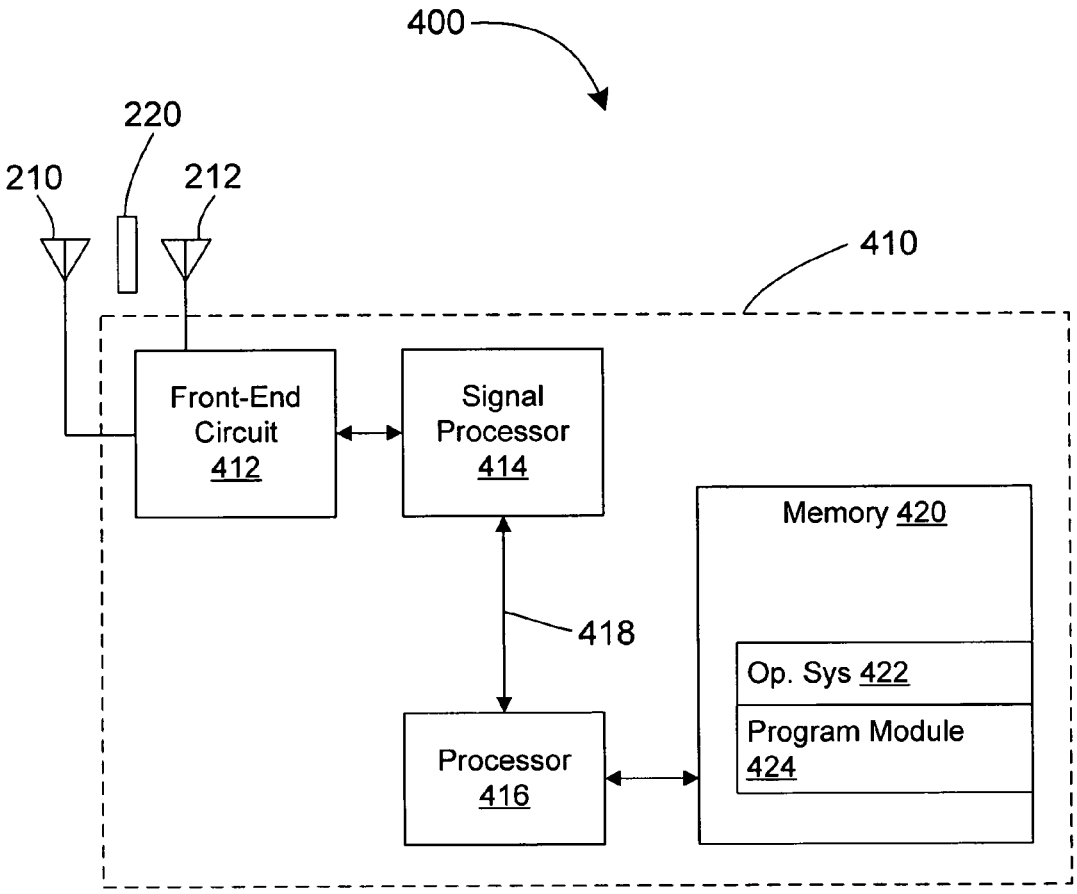
FIG. 4 is a diagram illustrating a communications system including a decoherence plate.

FIG. 4 illustrates a communications system 400 including a device 410 that is configurable to transmit and receive one or more electromagnetic signals. The device 410 includes the first antenna 210, the second antenna 212 and the decoherence plate 220. In other embodiments, the device 410 may include three or more antennas and/or two or more decoherence plates. The device 410 includes a front-end circuit 412 and a signal processor 414. The device 410 also has one or more processors 416, such as central processing units, and memory 420, which includes primary and optionally secondary storage. These components are interconnected by one or more communication busses 418. Memory 420 may include high speed random access memory and may also include non-volatile memory, such as one or more magnetic disk storage devices. Memory 420 may optionally include mass storage that is remotely located from the central processing unit(s) 416. Memory 420 stores:

an operating system 422, such as Linux or Unix or a real time operating system (e.g., VxWorks by Wind River Systems, Inc.) suitable for use on industrial or commercial devices, that includes procedures for handling various basic system services and for performing hardware dependent tasks; and a program module 424.

Transmitting and receiving one or more electromagnetic signals via the first antenna 210 and/or the second antenna 212 may be controlled via a communications module in the operating system 422 or in the program module 424.

Figure 6:
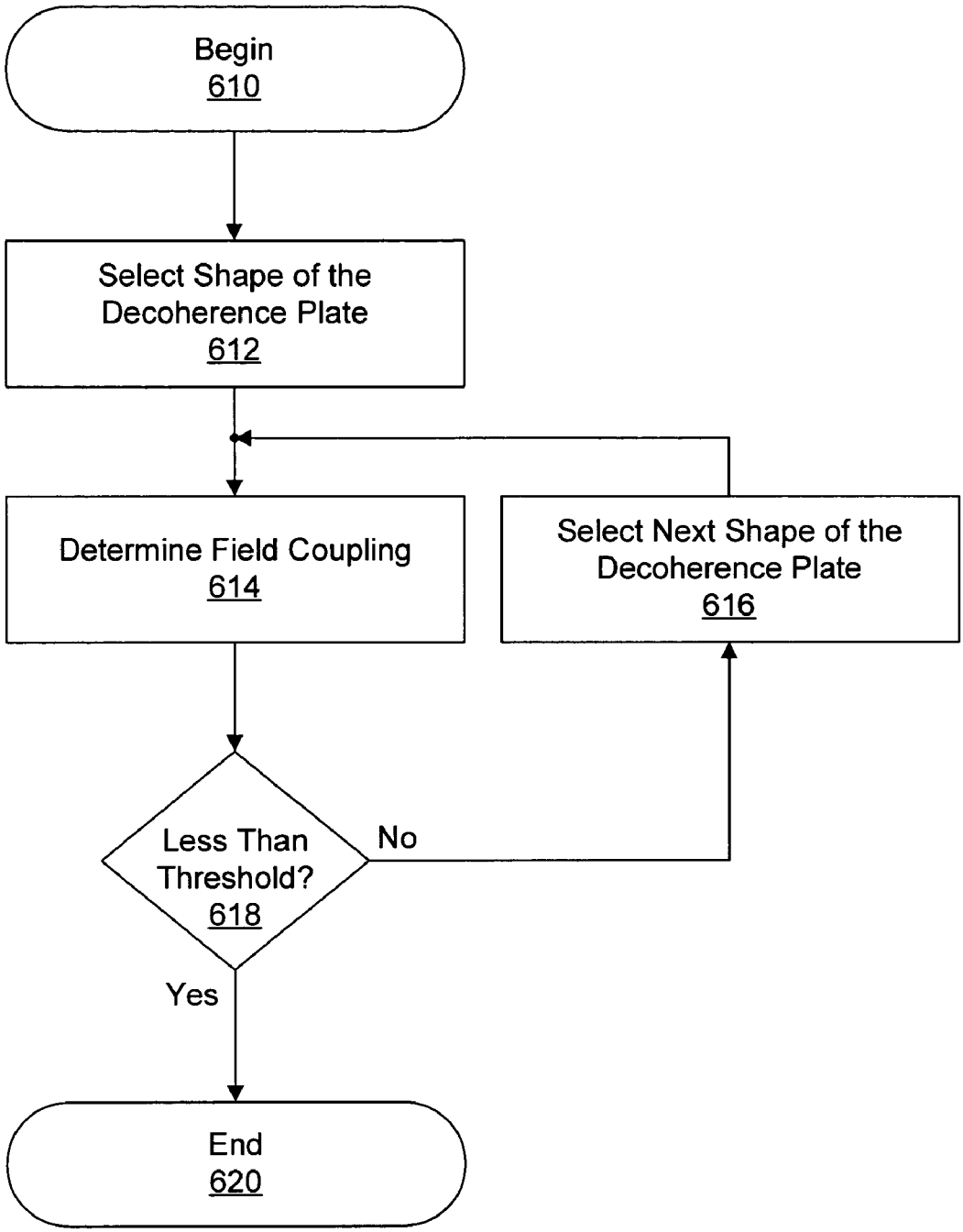
FIG. 6 is a flow chart illustrating the determination of a shape of the decoherence plate.

The shape of the decoherence plate 220 for a respective embodiment may be determined by calculating the field coupling between the first antenna 210 and the second antenna 212 for a respective geometry, such as that illustrated in FIG. 2, modifying the shape of the decoherence plate 220, and repeating the field coupling calculation and shape modifying until the field coupling is less than the desired threshold. This procedure is illustrated in the block diagram in FIG. 6. After beginning, 610, a shape of the decoherence plate 220 (FIG. 2) is selected 612. The field coupling is determined 614. The field coupling result from step 614 is compared to the desired threshold 618. If the field coupling is less than the threshold, the procedure ends 620. If the field coupling is larger than the threshold, a next shape of the decoherence plate 220 (FIG. 2) is selected 616 and steps 614, 616 and 618 are repeated until a shape of the decoherence plate 220 (FIG. 2) with the field coupling less than the threshold is determined.

In some embodiments, additional steps may be included in the procedure. For example, a respective shape for the decoherence plate 220 (FIG. 2) may be selected randomly in a Monte Carlo simulation thereby allowing the parameter space to be coarsely studied for promising shapes that are used as seeds or initial shapes in a subsequent, more detailed decoherence plate design analysis.

Figure 1:
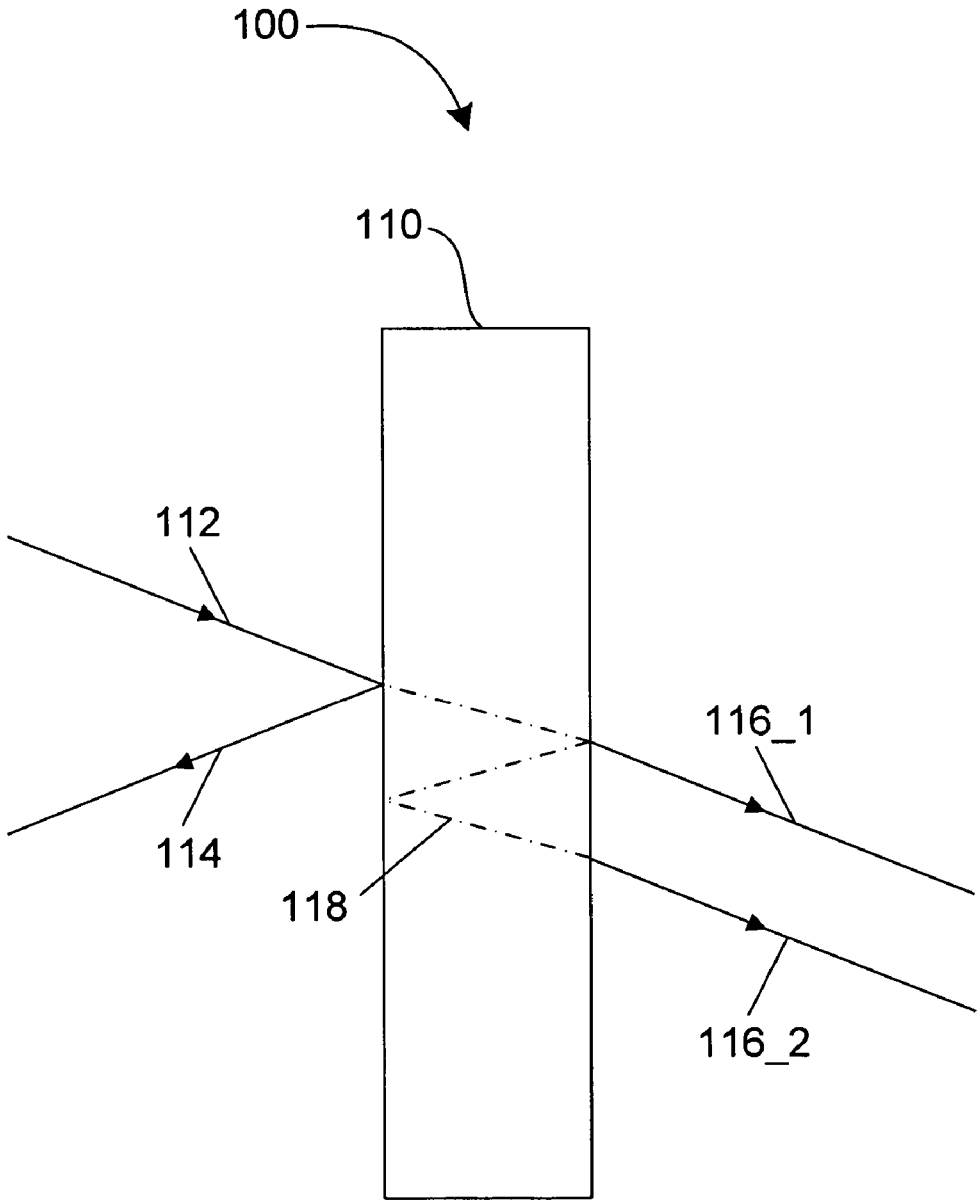
Fig. 1 (Prior Art)
FIG. 1 is a diagram illustrating conventional shielding for electromagnetic interference.
Figure 7:
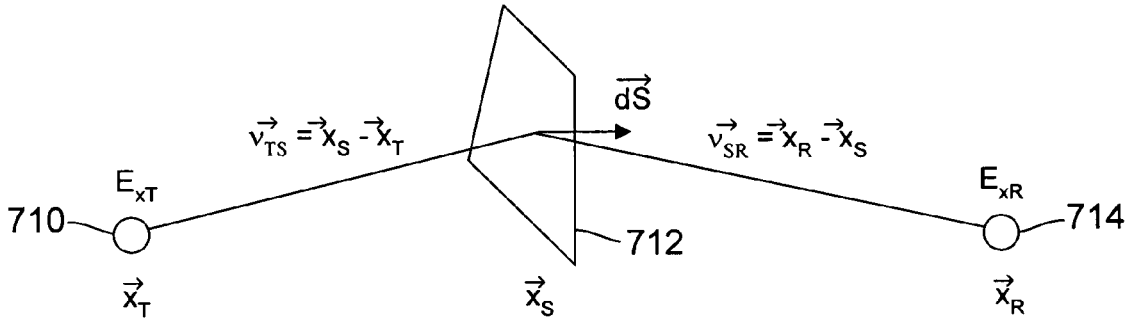
FIG. 7 is a diagram illustrating a geometry used in determining a field coupling.

In some embodiments, the field coupling may be determined using Kirchoff diffraction theory. A geometry used in such a calculation is illustrated in FIG. 7. For a respective direction, such as along the x-axis, the electric field component at the second antenna 212 (FIG. 2) or the receiver, $E_{xR}$, is calculated for a respective electric field component at the first antenna 210 (FIG. 1) or the transmitter, $E_{xT}$. The field coupling between a differential element in the transmitter 710 at vector position $x_T$ and a differential element in the receiver 714 at vector position $x_R$ via a differential surface element dS 712, the surface element dS 712 at vector position $x_S$ in the plane 318 (FIG. 3) and having a vector direction normal to the surface element dS 712, is determined using the following equation:

$$E_{RT} = \int\int dS \frac{-ig(\vec{x}_S)E_{xT}(\vec{v}_{TS})}{2\lambda}\left[\frac{\exp\left(i2\pi\frac{|\vec{v}_{TS}|+|\vec{v}_{SR}|}{\lambda}\right)}{|\vec{v}_{TS}||\vec{v}_{SR}|}\right]$$
$$\left[\left(1+\frac{i}{2\pi|\vec{v}_{TS}|}\right)(\hat{v}_{TS}\cdot d\hat{S})+\left(1+\frac{i}{2\pi|\vec{v}_{SR}|}\right)(\hat{v}_{SR}\cdot d\hat{S})\right],$$

where the symbol $|v_{TS}|$ represents a magnitude of a vector distance between the transmitter element 710 and the surface element dS 712, the symbol $|v_{SR}|$ represents a magnitude of a vector distance between the surface element dS 712 and the receiver element 714, g is a gain, λ is the respective wavelength, i is the square root of −1, and symbols with a hat denote unit vectors.

The double integral over surface elements in the plane 318 (FIG. 3), such as surface element dS 712, may be implemented numerically as a double sum. The double integral is performed over surface elements, such as surface element dS 712, that transmit electromagnetic signals. Note that the expression in the first bracket is a spherical wave Green's function. The expression in the second bracket is an obliquity term or component and includes a near-field expression. The obliquity component is a generalization of Fresnel obliquity based on the Kirchoff formulation. The remainder of the kernel is a weighting component including the gain g. The gain is a function of the position of the surface element in the plane 318 (FIG. 3). The shape of the decoherence plate 220 (FIG. 2) may be complicated, and further the decoherence plate may include two or more separate elements or segments in the plane 318 (FIG. 3). In some embodiments, including embodiments in which the entire decoherence plate 220 is covered by a metal layer that is substantially uniformly thick, the gain will have one value in places where the decoherence plate 220 is present and a second value in places in which the decoherence plate 220 is not present. Embodiments in which the gain has three or more distinct values are described below.

The calculation may be repeated for all pairings of differential elements in the first antenna 210 (FIG. 2) and the second antenna 212 (FIG. 2), taking care to avoid double counting. As a simplification, in some embodiments the first antenna 210 (FIG. 2) and the second antenna 212 (FIG. 2) may be approximated as dipoles situated at the differential element in the transmitter 710 and the differential element in the receiver 714.

The integral or sum may be performed over a surface area in the plane 318 (FIG. 3) including the shape of the decoherence plate 220 (FIG. 2). Referring to FIG. 3, if the thickness 320 of the first layer 310 in the decoherence plate 300 is larger than the skin depth, only surface elements at the edge of the shape of the decoherence plate 300 will contribute to the sum. In other embodiments where at least portions of the decoherence plate 300 transmit electromagnetic signals, the sum will, in general, include contributions over the surface area of the decoherence plate 300. In this case, each differential surface element dS 712 over the surface area of the decoherence plate 300 will transmit some of the electromagnetic signals, none of the electromagnetic signals or all of the electromagnetic signals incident on a respective surface element, such as surface element dS 712. In other embodiments, the sum may be performed over a surface area in the plane 318 extending beyond the shape of the decoherence plate 300.

For surface elements that transmit electromagnetic signals without a phase shift, the gain g is real number. For surface elements that transmit electromagnetic signals with a phase shift (relative to free space), the gain is a complex number, having a real portion and an imaginary portion. For example, if a decoherence plate 300 is fabricated by patterning a metal first layer 310 on a circuit board substrate 314, regions without metal will produce such a phase shift associated with the complex dielectric constant of the circuit board material. For complicated shapes of the decoherence plate 220 (FIG. 2), including two or more separate elements or segments in the plane 318, the field coupling contributions of the separate elements may be calculated separately and subsequently combined.

In some embodiments, the field coupling may be determined for two or more wavelengths.

Figure 5:
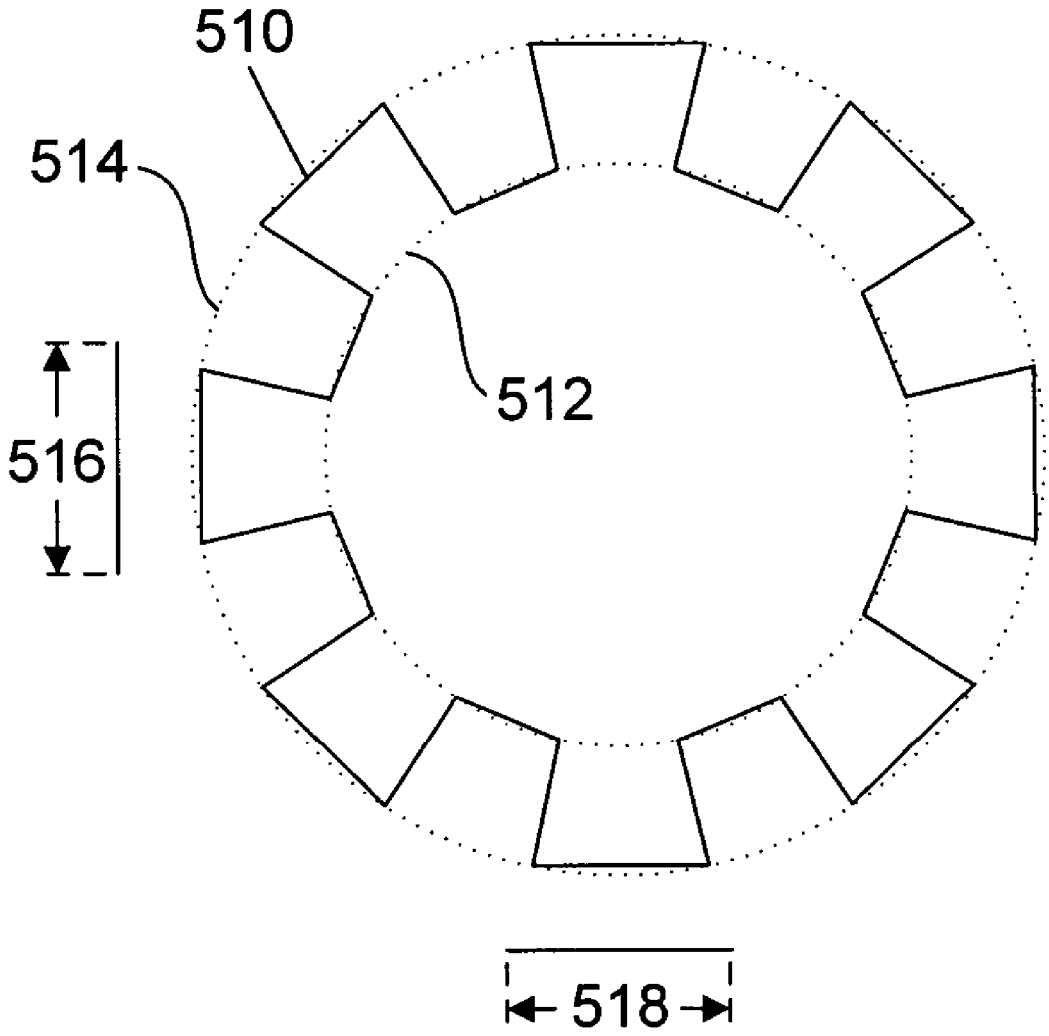
FIG. 5 illustrates an embodiment of a decoherence plate.

FIG. 5 illustrates an exemplary embodiment of a decoherence plate 510 for use at 5.2 GHz. When determining the shape of the decoherence plate 510, the first antenna 210 (FIG. 2) and the second antenna 212 (FIG. 2) were approximated as vertical dipoles. The first distance 216 (FIG. 2) is 5.72 cm and the second distance 218 (FIG. 2) is 41.28 cm. The sum of the first distance 216 (FIG. 2) and the second distance 218 (FIG. 2) is 47 cm. The field coupling corresponding to free space path loss between the first antenna 210 (FIG. 2) and the second antenna 212 (FIG. 2) is approximately 40 dB.

The decoherence plate 510 has a gear-like structure with teeth or cogs. Adjustable parameters in the shape of the decoherence plate 510 include a teeth width, a teeth length and a radius of the gear. A first ruler 516 and a second ruler 518 are each 5.08 cm, thereby illustrating the lateral extent in the plane 318 (FIG. 3) of the decoherence plate 510. In this embodiment, the maximum lateral extent is less than half of the distance between the first antenna 210 (FIG. 2) and the second antenna 212 (FIG. 2).

The decoherence plate 510 provides an additional 50-60 dB reduction in the field coupling relative to free space at 5.2 GHz. A decoherence plate having the shape of the first circle 514 would only provide approximately 21 dB additional reduction in the field coupling relative to free space. A decoherence plate having the shape of the second circle 512 would only provide approximately 20 dB additional reduction in the field coupling relative to free space.

As illustrated in FIG. 2, another exemplary embodiment of the decoherence plate 220 has a saw-tooth edge with triangular teeth. The edge diffracts all paths between the longest and the shortest path length with a uniform distribution. Adjustable parameters in this design include an apex angle of the triangular teeth, a height of the triangular teeth and an average radius of the decoherence plate 220.

The decoherence plate 220 reduces field coupling between antennas using a compact structure, as opposed, for example, to using a large ground plane. Decoherence plates can be designed for use with electromagnetic signals having a range of respective wavelengths or frequencies. Collectively, the ranges for different decoherence plates encompass the electromagnetic spectrum, including very low frequency, low frequency, medium frequency, radio frequency, microwave, infrared, visible, ultraviolet and x-ray.

The foregoing description, for purposes of explanation, used specific nomenclature to provide a thorough understanding of the invention. However, it will be apparent to one skilled in the art that the specific details are not required in order to practice the invention. The embodiments were chosen and described in order to best explain the principles of the invention and its practical applications, to thereby enable others skilled in the art to best utilize the invention and various embodiments with various modifications as are suited to the particular use contemplated. Thus, the foregoing disclosure is not intended to be exhaustive or to limit the invention to the precise forms disclosed. Many modifications and variations are possible in view of the above teachings.

It is intended that the scope of the invention be defined by the following claims and their equivalents.

The invention claimed is:

1. An antenna module, comprising:

a first antenna;

a second antenna; and a decoherence plate separated from both the first antenna and the second antenna by respective distances along a line connecting the first antenna and second antenna, the decoherence plate having a surface positioned substantially in a plane that is substantially perpendicular to the line connecting the first antenna and the second antenna, wherein for each first path from the first antenna to the plane to the second antenna in a plurality of paths having a predefined range of path lengths there is a corresponding second path, from the first antenna to the plane to the second antenna, that is substantially 180° out of phase with the first path for a respective wavelength in one or more electromagnetic signals transmitted by the first antenna, thereby reducing a field coupling between the first antenna and the second antenna.

2. The antenna module of claim 1, wherein the surface of the decoherence plate is intercepted by the line connecting the first antenna and the second antenna.

3. The antenna module of claim 1, wherein the field coupling between the first antenna and the second antenna at the respective wavelength is at least 30 dB less than a field coupling corresponding to free space path loss between the first antenna and the second antenna.

4. The antenna module of claim 1, wherein the field coupling between the first antenna and the second antenna at the respective wavelength is between 40 and 70 dB less than a field coupling corresponding to free space path loss between the first antenna and the second antenna.

5. The antenna module of claim 1, wherein the decoherence plate includes a metal layer.

6. The antenna module of claim 5, wherein the metal layer is thicker than a skin depth of the metal, the skin depth corresponding to a minimum frequency of the one or more electromagnetic signals transmitted by the first antenna.

7. The antenna module of claim 5, wherein the metal layer is patterned into a predetermined shape.

8. The antenna module of claim 7, wherein the predetermined shape has a maximum lateral extent that is no larger than a distance separating a dipole moment of the first antenna from a dipole moment of the second antenna.

9. The antenna module of claim 7, wherein the predetermined shape has a maximum lateral extent that is no larger than half a distance separating a dipole moment of the first antenna from a dipole moment of the second antenna.

10. The antenna module of claim 5, wherein the metal layer is selected from the group consisting of copper, aluminum, gold, silver and their related alloys and oxides.

11. The antenna module of claim 5, the decoherence plate further including a substrate, wherein the metal layer is deposited in a layer located above a surface of the substrate.

12. The antenna module of claim 11, wherein the substrate is a circuit board.

13. A communications system, comprising:

a device configurable to transmit and receive one or more electromagnetic signals; and an antenna module, including:

a first antenna, wherein the first antenna transmits the one or more electromagnetic signals;

a second antenna; and a decoherence plate separated from both the first antenna and the second antenna by respective distances along a line connecting the first antenna and second antenna, the decoherence plate having a surface positioned substantially in a plane that is substantially perpendicular to the line connecting the first antenna and the second antenna, wherein for each first path from the first antenna to the plane to the second antenna in a plurality of paths having a predefined range of path lengths there is a corresponding second path, from the first antenna to the plane to the second antenna, that is substantially 180° out of phase with the first path for a respective wavelength in the one or more electromagnetic signals, thereby reducing a field coupling between the first antenna and the second antenna.

14. The communications system of claim 13, wherein the surface of the decoherence plate is intercepted by the line connecting the first antenna and the second antenna.

15. The communications system of claim 13, wherein the field coupling between the first antenna and the second antenna at the respective wavelength is at least 30 dB less than a field coupling corresponding to free space path loss between the first antenna and the second antenna.

16. The communications system of claim 13, wherein the field coupling between the first antenna and the second antenna at the respective wavelength is between 40 and 70 dB less than a field coupling corresponding to free space path loss between the first antenna and the second antenna.

17. The communications system of claim 13, wherein the decoherence plate includes a metal layer.

18. The communications system of claim 17, wherein the metal layer is thicker than a skin depth of the metal, the skin depth corresponding to a minimum frequency of the one or more electromagnetic signals transmitted by the first antenna.

19. The communications system of claim 17, wherein the metal layer is patterned into a predetermined shape.

20. The communications system of claim 19, wherein the predetermined shape has a maximum lateral extent that is no larger than a distance separating a dipole moment of the first antenna from a dipole moment of the second antenna.

21. The communications system of claim 19, wherein the predetermined shape has a maximum lateral extent that is no larger than half a distance separating a dipole moment of the first antenna from a dipole moment of the second antenna.

22. The communications system of claim 17, wherein the metal layer is selected from the group consisting of copper, aluminum, gold, silver and their related alloys and oxides.

23. The communications system of claim 17, the decoherence plate further including a substrate, wherein the metal layer is deposited in a layer located above a surface of the substrate.

24. The communications system of claim 23, wherein the substrate is a circuit board.

25. A method of determining a shape of a decoherence plate for a respective geometry having a first antenna and a second antenna, comprising:

selecting a shape of the decoherence plate in a plane substantially perpendicular to a line connecting the first antenna and the second antenna, wherein the decoherence plate is separated from both the first antenna and the second antenna by respective distances along the line;

determining a field coupling between the first antenna and the second antenna for a respective wavelength of an electromagnetic signal;

selecting a next shape for the decoherence plate in accordance with a result from the determining; and repeating the determining and selecting a next shape until the field coupling between the first antenna and the second antenna is less than a threshold.

26. The method of claim 25, wherein the determining includes:

summing a Kirchoff diffraction kernel in the plane of the decoherence plate at least over a surface area comprising the shape of the decoherence plate, wherein the Kirchoff diffraction kernel includes a product of a weighting component, a spherical wave Green's function and an obliquity component that includes a near-field expression.

27. The method of claim 26, wherein the summing is performed in the plane of the decoherence plate over a surface area extending beyond that defined by the shape of the decoherence plate.

28. The method of claim 26, wherein the weighting component includes a real portion and an imaginary portion.

29. The method of claim 25, wherein the determining is performed for two or more wavelengths in the electromagnetic signal.

30. The method of claim 25, wherein the threshold is at least 30 dB less than a field coupling corresponding to free space path loss between the first antenna and the second antenna.

31. The method of claim 25, wherein the threshold is between 40 and 70 dB less than a field coupling corresponding to free space path loss between the first antenna and the second antenna.

32. The method of claim 25, wherein the decoherence plate includes two or more separate segments.

* * * * *